US006461082B1

(12) United States Patent
Smith

(10) Patent No.: US 6,461,082 B1
(45) Date of Patent: Oct. 8, 2002

(54) ANODE SYSTEM AND METHOD FOR OFFSHORE CATHODIC PROTECTION

(75) Inventor: Stephen N. Smith, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 12 days.

(21) Appl. No.: 09/643,775

(22) Filed: Aug. 22, 2000

(51) Int. Cl.[7] ..... E02D 31/00; C23F 13/00

(52) U.S. Cl. ..... 405/211.1; 405/195.1; 405/211; 204/196.3; 204/196.17; 204/196.34

(58) Field of Search ..... 405/195.1, 211, 405/211.1, 203, 208, 224, 227, 216, 172; 204/196.11, 196.14, 196.17, 196.18, 196.2, 196.3, 196.33, 196.34; 205/731, 732, 733, 738, 739

(56) References Cited

U.S. PATENT DOCUMENTS

| | | | | | |
|---|---|---|---|---|---|
| 1,664,800 | A | * | 4/1928 | Mills | 204/196.16 X |
| 2,870,079 | A | * | 1/1959 | McCall | 204/196.2 |
| 3,616,418 | A | * | 10/1971 | Anderson et al. | 204/196.35 |
| 3,834,169 | A | * | 9/1974 | Abbott | 405/170 |
| 3,870,615 | A | * | 3/1975 | Wilson et al. | 204/196.18 |
| 4,089,767 | A | | 5/1978 | Sabins | 204/197 |
| 4,090,170 | A | | 5/1978 | Lincklaen-Arriens et al. | 340/5 |
| 4,143,540 | A | * | 3/1979 | Peterson et al. | 405/211.1 X |
| 4,251,343 | A | | 2/1981 | Peterson et al. | 204/197 |
| 4,292,149 | A | * | 9/1981 | Warne | 204/147 |
| 4,415,293 | A | * | 11/1983 | Engel et al. | 405/216 |
| 4,445,804 | A | * | 5/1984 | Abdallah et al. | 405/173 |
| 4,484,838 | A | | 11/1984 | Stevens | 405/191 |
| 4,484,839 | A | | 11/1984 | Nandlal et al. | 405/211 |
| 4,484,840 | A | | 11/1984 | Nandlal et al. | 405/211 |
| 4,489,277 | A | | 12/1984 | Goolsby | 324/425 |
| 4,526,666 | A | * | 7/1985 | Bianchi et al. | 204/196.33 X |
| 4,544,465 | A | * | 10/1985 | Marsh | 204/148 |
| 4,609,307 | A | | 9/1986 | Guy et al. | 405/211 |
| 4,629,366 | A | | 12/1986 | Rutherford et al. | 405/211 |
| 4,639,677 | A | | 1/1987 | Goolsby | 324/425 |
| 4,740,106 | A | | 4/1988 | Bianchi et al. | 405/211 |
| 4,793,418 | A | * | 12/1988 | Wheeler et al. | 405/195.1 X |
| 5,425,599 | A | * | 6/1995 | Hall et al. | 405/172 |
| 5,480,521 | A | | 1/1996 | Snyder, Jr et al. | 204/148 |
| 5,553,975 | A | * | 9/1996 | Elkins | 405/172 X |
| 5,785,457 | A | * | 7/1998 | Thompson et al. | 405/172 |
| 5,899,639 | A | * | 5/1999 | Simmons | 405/195.1 X |
| 6,142,707 | A | * | 11/2000 | Bass et al. | 405/158 |

FOREIGN PATENT DOCUMENTS

| | | | |
|---|---|---|---|
| JP | 06340986 | * | 12/1994 |
| JP | 08151617 | * | 6/1996 |

* cited by examiner

*Primary Examiner*—Heather Shackelford
*Assistant Examiner*—Jong-Suk Lee
(74) *Attorney, Agent, or Firm*—Denise Y. Wolfs

(57) ABSTRACT

A cathodic protection system for offshore structures includes an elongated electrode carrier, such as a pipe, with a plurality of sacrificial anodes attached, that is placed on the ocean floor and electrically connected to the structures to be protected. The system is particularly useful for retrofitting cathodic protection systems for offshore structures that have exceeded their expected life.

20 Claims, 2 Drawing Sheets

ANODE SYSTEM AND METHOD FOR OFFSHORE CATHODIC PROTECTION

FIELD OF THE INVENTION

This invention relates to a method and apparatus for providing additional or replacement anodes to retrofit cathodic protection systems to control the corrosion of marine structures.

BACKGROUND

Present day offshore platforms used in the oil and gas industry are often formed of large-diameter pipe elements in the form of three or more vertical or slanting legs interconnected or reinforced by cross-bracing tubular members. Such bottom-supported platforms have been set in waters up to 1200 feet deep. The deepwater platforms may have more legs which may be tapered. In addition, the platform is provided with multiple vertical pipes, risers or well conductors which are grouped near the center of the platform and through which wells are drilled. Further, the platform supports vertical pipe risers through which oil and gas may be separately pumped down to an ocean floor pipeline and then via pipeline to shore or to another platform.

These offshore structures, pipelines and subsea installations are generally built from steel. Steel structures in seawater require cathodic protection to prevent rapid wastage by corrosion. For large, permanently installed structures, corrosion is usually prevented by the use of cathodic protection, sometimes supplemented with paints or coatings. In seawater, cathodic protection is generally applied by attaching either aluminum or zinc sacrificial anodes. The anodes corrode to produce an electrical current that protects the steel structure from corrosion. When these anodes are consumed by corrosion, they must be replaced, or retrofitted.

Corrosion in seawater is an electrochemical process. During the chemical reaction of metals with the environment to form corrosion products (such as rust on steel), metallic atoms give up one or more electrons to become positively charged ions, and oxygen and water combine to form negatively charged ions. The reactions occur at rates which result in no charge buildup. All the electrons given up by the metal atoms are consumed by the other reaction.

Cathodic protection is a process which prevents the corrosion reaction by creating an electric field so that current flows into the metal. This prevents the formation of metal ions by setting up a potential gradient at the surface, which opposes the electric current produced by flow of electrically charged ions away from the metal surface as the product of corrosion. The electric field must be of adequate strength to counter the field produced by the corrosion reaction to ensure that metal ions are fully prevented from escaping.

A source of the electric field which opposes the corrosion reaction may be a current supplied from the preferential corrosion of a metal anode with different electrochemical properties in the environment, and which has a stronger anodic reaction with the environment than does the offshore structure. Thus, current flows to the structure from the additional anode, which itself progressively corrodes in preference to the structure. This technique is known as sacrificial anode cathodic protection.

In order to protect the offshore platforms from corrosion in sea water, the structural members of the platform are typically provided with a cathodic protection system which is comprised of a multitude of sacrificial anodes, which are preferably made of alloys of aluminum or zinc, that are attached directly to the platform in a manner that has been in use since the 1960's.

When a sacrificial anode system is chosen, the weight of material required to provide the protection current for the protected lifetime of the structure is calculated from a knowledge of the current demand of the structure and also the specific electrochemical properties of the anode alloy. The calculated weight of anode alloy cannot be installed all in one piece but must be distributed over the structure in the form of smaller anodes to ensure uniform distribution of current. In order to select the best size and shape of anode, the total current demand of the structure both at the beginning and end of its life must be considered. The anode must deliver adequate current to polarize the structure and build up cathodic carbonate scales on the metal surface, but also must be capable of delivering the required mean current for the structure when 90% consumed. Thus on most offshore platforms, a multiplicity of anodes are arranged on the various structural members of the platform. These anodes are generally attached to the platform before the platform is lowered into the ocean floor.

Cathodic protection of marine structures is usually designed to last for the life of the structure. When either the structure's operational life is extended, or the original design requires supplementation prior to the end of life, a retrofit cathodic protection system must be installed. In shallow water, retrofit anodes are commonly installed by divers. For structures that are located in water that is deep enough to require saturation diving or remote operated vehicles (ROVs), the conventional practice can become prohibitively expensive.

For small sea bottom structures, such as the wellhead templates used to protect subsea production systems, a problem can arise with attaching sufficient anodes. The anodes needed to protect the template, the subsea equipment within the template, the well casings and the flowlines that carry fluids to and from the template must all be located on the template. The templates are desired to be small. There may not be a sufficient number of sites around the template that are suitable for the attachment of enough sacrificial anodes to provide the desired protection.

The placement of objects on the sea floor in the area around an offshore structure is strictly controlled. Safety concerns about anchors from ships and supply boats damaging the subsea pipelines usually require that all shipping activities be limited to one side of the platform and that the pipeline risers be located on the opposite side. For any objects that must be placed on the sea floor, one must consider the locations of pipelines as well as the potential damage that might be caused by anchors or propeller wash from ships or boats.

Offshore pipelines may also require retrofit of cathodic protection anodes. Most pipelines have anodes that are attached as the pipeline is being laid on the sea bottom. These anodes are designed to last for a specific number of years that corresponds with the original design life of the pipeline. In cases where the cathodic protection design was not correct or where the useful life of the pipeline extends beyond the original design life, it is necessary to retrofit anodes onto the pipeline. Since pipelines in shallow water are buried, this means that a diver must dig out a section of the pipeline, remove any external coatings from the pipe and then weld a new anode to the pipe. Since anodes are often installed every 500 to 1000 feet along the pipe, this can be extremely expensive. In the case of pipelines in deeper water, the pipeline may not be buried, but the pipeline will usually be at water depths where normal diving operations cannot be conducted. The use of saturation diving or remote operated vehicles (ROVs) to attach retrofit anodes to a pipeline is also very expensive.

Various types of anode retrofits have been used. Anode piles have been proposed by Shell (U.S. Pat. Nos. 4,484,839 and 4,484,840) to retrofit anodes on deepwater platforms. However, the use of anode piles requires pile guides, to physically hold the anode piles against the platform. Not all platforms have existing pile guides that are available for this use.

Anode sleds have also been used on both platforms and pipelines (see U.S. Pat. No. 4,609,307). The anodes are attached to sleds or pods that are placed on the ocean bottom and electrically connected to the structure or pipeline. However, fabrication and installation practices place practical limitations on the physical size of the sleds. This size restriction limits the number of anodes that can be attached and the spacing of anodes on the sled. When anodes are placed too close to each other on the sled, the anodes will start to electrically interfere with each other, thereby limiting the amount of electrical current that each sled can produce. On a large, deepwater structure, many sleds may be required to produce the desired amount of electrical current. The physical space around the structure available for such use may limit the number of sleds that can be installed, hence making this approach impractical.

It is an object of this invention to provide a novel, cost-effective way to retrofit cathodic protection systems on marine structures.

SUMMARY OF THE INVENTION

The subject invention is a cathodic protection system for offshore structures, which is particularly useful when used to retrofit offshore structures that have exceeded their expected life or require supplemental cathodic protection. Alternatively, the invention may also be applied to new offshore structures. The subject invention is particularly applicable to smaller structures, such as sub-sea templates or subsurface production systems, which may not have sufficient structural elements to provide attachment spots for a multiplicity of protecting anodes.

The anode system of the invention includes an elongated anode carrier with a plurality of sacrificial anodes attached, and a conductor cable to attach the electrode carrier to the protected offshore structure. The anode carrier is preferably a long pipe. Conventional anodes, available in various shapes and materials, are attached to the carrier. The anode carrier is generally very long, and may be longer than the depth of the ocean near the offshore structure.

The subject invention offers the advantage of what is, in effect, a multiplicity of anodes, that may be attached to an existing structure with as few as one connection. The anode system may be assembled, but for the final connection to the structure to be protected, above the water, and perhaps even in an onshore fabrication shop, depending upon the type of assembly utilized. The minimal number of connections to the protected structure minimizes the time that divers and/or ROVs must spend to make the under-water connections, thus simplifying installation and reducing costs. Placing the anode system on the sea bottom allows it to be supported by the ocean floor, which avoids the necessity of providing attachment points that will physically support the weight of each anode, in addition to providing electrical conductivity.

DETAILED DESCRIPTION OF THE INVENTION

Figure 1:
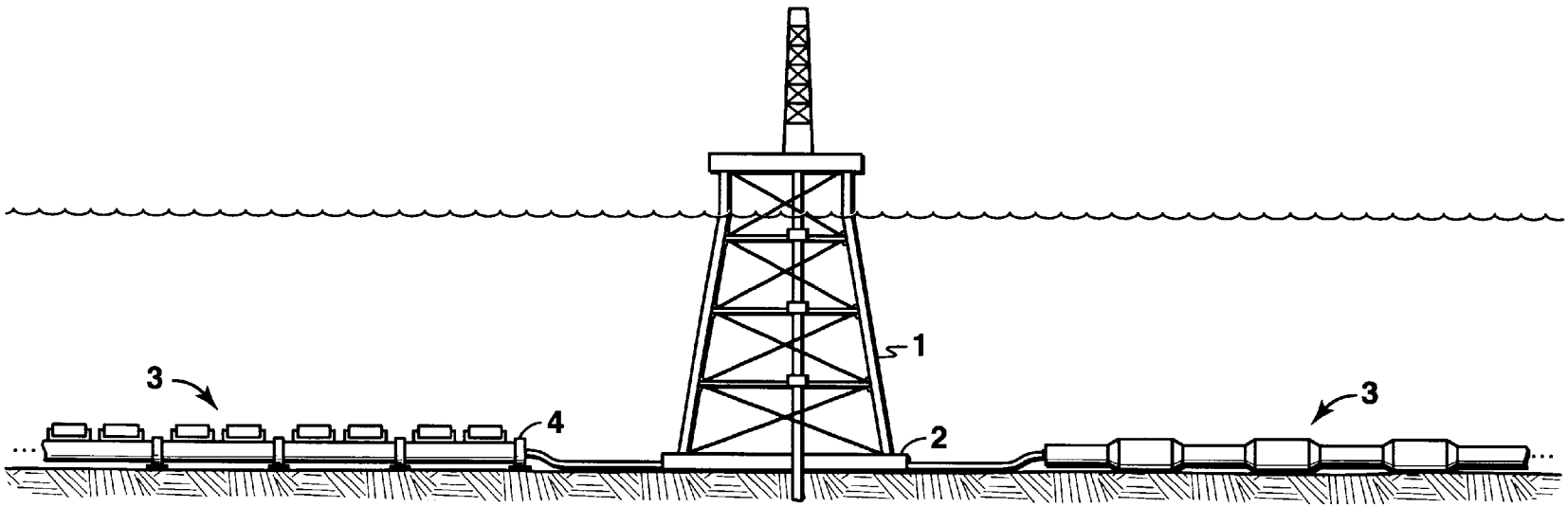
FIG. 1 is a schematic elevation view of the cathodic protection system for an offshore structure.

The subject invention provides cathodic protection to an offshore structure by attaching a plurality of sacrificial anodes to an anode carrier, such as a pipe, to form a cathodic protection system, or anode system, that is laid on the sea bottom and connected to the structure to be protected. Conventional anodes are available in a variety of sizes, shapes, and materials (such as aluminum, magnesium, zinc, and alloys thereof). Other metals, such as indium or mercury may also be present in alloy anodes. The anodes are attached to the carrier or pipe onshore, and then the pipe is placed on the sea bottom using the same technology that is currently used to lay the pipelines to and from the structure. This provides a more economical method of attaching retrofit anodes to a structure than to use divers to individually place multiple anodes, one at a time, on the structure.

The pipe that is preferably used as the anode carrier may be any pipe that would be suitable for a subsea pipeline. The size and wall thickness should be sufficient to carry the anodes attached, and to survive a drop from the ocean surface to the ocean bottom. Generally, the pipe would be steel, and include several sections welded or otherwise connected together. The anodes may be attached to the pipe sections, and then the pipe sections with anodes attached combined to form a long anode system, or the anodes may be attached to the complete pipe/carrier. The long anode system is preferably at least 20 feet long. An alternative anode carrier is any long structure that is electrically conductive and capable of carrying the anodes. For example, a steel I-beam is an alternative carrier.

When the anode carrier is a pipe, placing the anode system on the sea bottom allows use of technologies that are currently applied to laying pipelines and flowlines. Very long anode carriers, capable of supporting many anodes and reaching several kilometers if desired, can also be produced and installed. For example, an ocean-going pipe-laying barge may be used to assemble sections of the pipe with anodes attached (particularly when bracelet-type anodes are used), while continuously dropping the anode into the ocean as it is assembled. Alternatively, the anode system could be assembled on shore, and towed or barged to the location where it is to be dropped to the ocean floor.

The ocean bottom is often rather soft, and it is preferable to have the anode carrier, or at least the anodes carried, be above the mud line. This maximizes current output from the anode, since the resistivity of the ocean bottom mud is much higher than the open water (100 ohm-cm versus 20 to 30 ohm-cm). The anode carrier is therefore preferably placed on some type of support system, such as a "mud mat" or other latticework, or some type of pipe rack, to prevent the pipe from sinking into the mud. The use of such support systems is preferred when conventional block-type anodes are used, but may be unnecessary when bracelet-type anodes are used.

A conductor or grounding cable is used to connect the anode carrier to the structure being protected. Such cables would generally be flexible, but might be rigid. The cables should be long enough to connect the anode carrier to the protected structure, without any unnecessary slack length. Grounding cables may be attached at one or both ends of the anode carrier, but for a long anode system, a cable would usually be attached to only one end. Generally, more than one large diameter cable (such as a 4/0 cable) would be preferred, to provide sufficient current flow. Copper is the preferred material for the conductor cables because of its low electrical resistance, although other materials, such as aluminum or steel, could be used. The cables are preferably coated or insulated, such that they are electrically isolated from the environment. The cable would be electrically connected (mechanically, via welding, or some equivalent means) to the anode carrier at one end, and to a non-critical part of the protected structure (such as an expended anode core or a stiffener ring on a platform leg) at the other end. The grounding cable(s) might also be used as a type of electrical resistor to limit current output from the anode system, which will extend the life of the system.

The invention may also be employed to retrofit anodes on offshore pipelines. An anode system would be prefabricated and attached periodically along the pipeline. Since the anode system can be designed to produce very large currents, the distance between anode systems can be greater than is possible with retrofits that use conventional pipeline anodes.

The invention may also be employed as a method of applying cathodic protection to new offshore structures and pipelines. In the case of subsea templates, the anode system is prefabricated onshore and placed at the same time that the template is set on the bottom. Varying the number and length of the anode carriers would allow the desired cathodic protection current to be produced without needing to worry about whether an adequate number of anodes could be attached to the template. The anode carrier(s) are attached to the template, and sized to accommodate the requisite number of anodes.

Two alternative embodiments of the invention are shown in the Figures. In one embodiment, the invention comprises sacrificial anodes that are attached to an anode carrier, such as a pipe, with a cable for connection to a protected structure, forming an anode system. The sacrificial anodes can be of the alloys of aluminum, zinc or magnesium that are anodic to steel and can exist as conventional pipeline anode bracelets or as trapezoidal block castings. Either of these embodiments could be used as retrofit anodes on existing structures or pipelines, or to provide the required cathodic protection system for a new subsea installation.

FIG. 1 shows an offshore structure 1 placed on the ocean floor with a template 2 and attached anode systems 3. One of the anode systems includes supports 4.

Figure 2:
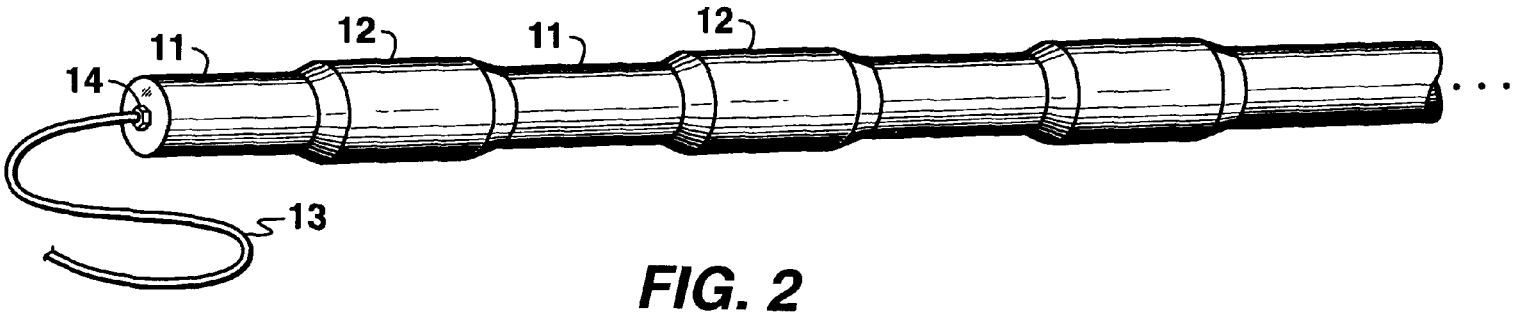
FIG. 2 is a diagrammatic view of a section of the anode carrier and attached bracelet anodes.

FIG. 2 shows the use of anodes cast in bracelet form. The anode bracelets 12 would be installed on a short, large diameter pipe 11, perhaps 48 inches (1.2 meters) diameter and 40 feet (14 meters) in length. This design could produce a large current and would require careful design of the grounding cable 13 to provide the correct resistance to choke back the current output and extend the anode life. In this embodiment, the grounding cable 13 is connected to the anode carrier pipe 11 with a bolt 14.

Figure 3:
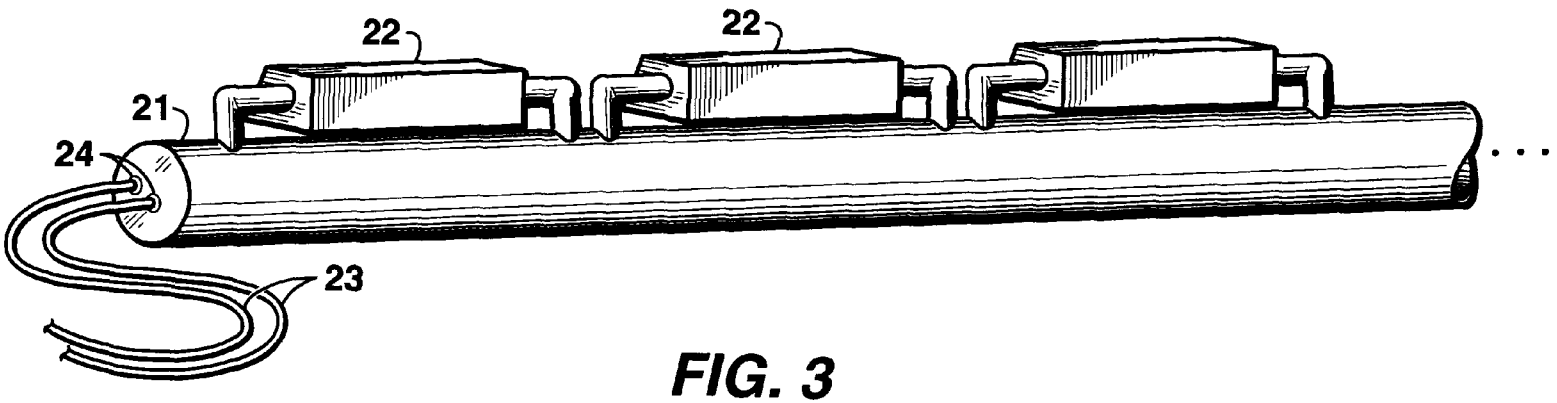
FIG. 3 is a diagrammatic view of a section of the anode carrier and attached block anodes.

FIG. 3 shows a pipe carrier 21 and block anodes 22, cast using typical offshore platform anode shapes. These anodes are attached as either one or two rows along a smaller diameter pipe of about 8 to 12 inches (20 to 30 cm) in diameter. This anode pipe assembly would be placed next to the structure to be protected. The connection between the pipe assembly and the platform would be made with two or three large copper cables 23 of less than 50 feet (15 meters) length. In this embodiment, the copper cables 23 are connected to the anode carrier pipe 21 with welds 24. The length and number of anode carriers and the actual size of the anodes would be varied depending upon the cathodic protection current required and the remaining life of the structure to be protected. A typical design might produce an anode pipe that is 1000 feet (300 meters) long and has two rows of aluminum anodes that are each 10 feet (3 meters) long and weigh 1200 pounds (540 kilograms).

The following is an explanation of the calculation methods used to select and size the anodes and anode carriers of the subject invention.

Since the current output of an anode (I), as defined by Ohm's Law and Dwight's Equation is:

$$I = \frac{E}{R}$$

where the driving voltage (E) is the difference in potential between the anode and the structure being protected, and electrode resistance (R), is a function of length (L) and radius (r), and the seawater resistivity (ρ):

$$R = \frac{\rho}{2\pi L}\left[\ln\left(\frac{4L}{r}\right) - 1\right]$$

The current output of the anode is increased by placing individual anodes end-to-end on the pipe. This increases the effective length of the anode and therefore the current output. Ten anodes placed end-to-end will produce about ten times as much cathodic protection current as one anode, because the L in the denominator overrides the effect of L in the log term.

The anode design must also be capable of producing the cathodic protection current for the desired life. If a single line of block anodes on the carrier is not sufficient to provide the requisite life, either larger anodes can be used or additional rows of block anodes can be added to a single carrier. By locating the additional lines of block anodes in close proximity to the first row, the current output is only slightly increased. The resistance of this new, more complex anode is calculated using Sunde's Equation and Ohm's Law:

$$R = \frac{\rho}{2\pi L}\left[\ln\left\{\left(\frac{2L}{r}\right) * \left(1 + \sqrt{1 + \left(\frac{r}{2L}\right)^2}\right)\right\} + \frac{r}{2L} - \sqrt{1 + \left(\frac{r}{2L}\right)^2}\right]$$

where $$r = \sqrt[N]{(N r_{anode}) * \left(\frac{D}{2}\right)^{N-1}}$$

$D$ = distance between anodes, and $N$ = number of anode rows.

The size of the anode carrier depends upon the embodiment of the invention that is selected. In the case where block anodes are used, the pipe must be strong enough to support the weight of the anodes during fabrication, construction and placement of the anode carrier on the sea bottom. The actual diameter of the carrier or pipe is only important if more than one line of anodes is attached. The overall steel cross sectional area of the carrier can be important. The carrier is not only a structural member, but is also an electrical conductor that carries the current produced by the anodes to the grounding strap connection to the structure. Increasing the cross section of the carrier material, for example by increasing the diameter of the pipe or by increasing the wall thickness, will reduce the resistance of the carrier and may thereby increase the current produced by the anode system at the end of the anode system attached to the protected structure. Conversely, reducing the cross section of the carrier by reducing diameter or wall thickness could be used to limit current output or to reduce the uniformity of current produced along the length of the anode carrier. This reduction in uniformity would be caused by the differences in resistance in the pipe between individual anodes and the grounding cable.

In the case where anode bracelets are used, the diameter of the carrier must be suitable for the diameter of the anode bracelets used. In general, the larger the diameter of the carrier, the greater the current output. The current produced by anode bracelets has generally been calculated by McCoy's Equation and Ohm's Law:

$$R = \frac{0.315\rho}{\sqrt{A}}$$

where A is the surface area of the anode in $cm^2$. Use of McCoy's Equation is required because the value 4L/r in Dwight's equation is only valid when the axial length of the anode bracelet (L), is much greater than the anode radius (r). In the case of multiple bracelets on an anode carrier, Dwight's Equation should be used when 4L is much greater than r and McCoy's Equation should be used when 4L is similar to or smaller than r.

The means and method for practicing the invention and the best mode contemplated for practicing the invention have been described. It is to be understood that the foregoing is illustrative only and that other means and techniques can be employed without departing from the scope of the invention as claimed herein.

EXAMPLES

The bottom portion of a conventional platform that has been in service for 20 years requires retrofit anodes so that it can remain in service for another 25 years. The top portions of the platform are retrofit using conventional anode retrofit techniques. A conventional retrofit to the portions of the platform near the ocean bottom is not feasible due to depth limitations on diving and the diver time-on-bottom that these procedures would require.

The surface area of exposed steel that requires protection is 130,516 square feet (12,130 square meters). The resistivity of the seawater is 28 ohm-cm. Using the invention described, the bottom of the platform can be protected using six (6) anode pipe systems. Each of the anode systems would be 250 feet (76 meters) in length and would consist of a 12-inch (300 mm) diameter steel pipe to which two rows of magnesium block anodes would be attached. The 12-inch (300 mm) pipe and the exposed steel portions of the anode cores are painted with epoxy paint following attachment of the anodes to reduce the amount of cathodic protection current that flows to the exposed steel of the pipe and the anode core.

The individual magnesium anodes are cast in a mold that is typical for offshore aluminum anodes. The dimensions of the anode are 10 feet (3 meters) in length with a 9.5 inch by 10.5 inch (24 cm by 27 cm) trapezoidal cross section. The weight of magnesium in the anode is approximately 800 pounds (360 kg). Each anode is cast onto a 6-inch (15 cm) diameter steel pipe. The pipe is bent so that both ends exit the same broad side of the anode. The ends of the pipe are welded to the 12-inch (30 cm) diameter steel pipe so that the magnesium portion of the anode is held approximately 12 inches (30 cm) away from the steel pipe. Multiple magnesium anodes are attached end-to-end to the carrier pipe to form two rows of anodes. These rows are located so that the angle between them would be between 90 and 180 degrees.

Each of the six anodes is placed on the sea bottom so that the anodes are evenly distributed around the platform. In this application, the ocean bottom is rather soft. The anode pipe is therefore placed on mud mats to prevent the pipe from sinking into the mud. This maximizes current output from the anode since the resistivity of the ocean bottom mud is much higher than the open water.

An electrical connection between the anodes and the platform is made using a pair of copper cables that are each about 50 feet (15 meters) in length. One end of each cable is attached to the anode carrier by brazing or silver-soldering during fabrication of the anode system. The other end of each cable is connected to the bottom portion of the platform. This underwater connection can be made by a number of mechanical or underwater welding methods currently in use.

Calculations illustrating the use of both aluminum block anodes and magnesium bracelet anodes to form anode systems are shown below. Also shown, for comparison, is a calculation for conventional anode pairs. These calculations illustrate that at least 112 anode pairs would need to be installed on an offshore structure to obtain the equivalent current output from the six anode pipe systems of the invention. Since each anode pair must be installed individually by a diver or ROV, this means that conventional anode pairs would require over sixteen times as many dives (112 anode pairs versus six anode pipe systems) to complete the overall anode retrofit installation. Diving costs and support boat expenses are usually far more expensive than onshore fabrication or material costs. The anode pipe will therefore be less expensive overall to install.

Aluminum Anode Pipe Calculation Example

Pipe Length=150 meters

Pipe Outside Diameter=400 mm

Number of anode rows=2

Structure Surface Area=12130 $m^2$

Required current density=75 $mA/m^2$

Anode Material=Aluminum-Zinc-Indium sacrificial anode alloy

Anode Current Capacity=2535 amp-hr/kg

Anode Dimensions=3 m×280 mm×250 mm (Trapezoidal Prism)

Anode Weight of Al=540 kg

Anode Core=150 mm, schedule 80 pipe

Anode standoff=300 mm $$\text{Number of Anodes} = \frac{150\,\text{m}}{(3\,\text{m long} + 300\,\text{mm spacing})} * 2 \text{ rows} = 90 \text{ anodes}$$

Seawater Resistivity=25 ohm-cm

Resistance/1000 m of 4/0 copper cable=0.1482 ohm

Grounding=dual 4/0 cables each 15 m long $$r_{anode} = \frac{(280\ \text{mm} * 2 + 250\ \text{mm} * 2)}{2\pi} = 168\ \text{mm}$$

$$r = \sqrt{2r_{anode} * \left(\frac{300\ \text{mm} * 2 + 400\ \text{mm}}{2}\right)} = 410\ \text{mm}$$

Anode Resistance =

$$\frac{\rho}{2\pi L}\left\{\ln\left\{\left(\frac{2L}{r}\right) * \left(1 + \sqrt{1 + \left(\frac{r}{2L}\right)^2}\right)\right\} + \frac{r}{2L} - \sqrt{1 + \left(\frac{r}{2L}\right)^2}\right\}$$

where $L = 150$ m $$= \frac{28\ \text{ohm-cm}}{2\pi 150\ \text{m.}}\left\{\ln\left\{\left(\frac{2 * 150\ \text{m}}{410\ \text{mm}}\right) * \left(1 + \sqrt{1 + \left(\frac{410\ \text{mm}}{2 * 150\ \text{m}}\right)^2}\right)\right\} + \left(\frac{410\ \text{mm}}{2 * 150\ \text{m}}\right) - \sqrt{1 + \left(\frac{410\ \text{mm}}{2 * 150\ \text{m}}\right)^2}\right\} = 0.00187\ \text{ohm}$$

$$r_{cable} = \frac{0.1482 * 10^{-3}\ \text{ohm/m} * 15\ \text{m}}{2\ \text{conductors}} = 0.00111\ \text{ohm}$$

Anode Output =

$$\frac{1.10\ \text{V} - 0.80\ \text{V}}{\text{Anode Resistance} + r_{cable}} = \frac{0.3\ \text{V}}{(0.00187 + 0.00111)\ \text{ohm}} = 100\ \text{amps}$$

System Life =

$$\frac{2535\ \text{amp hr}}{\text{kg}} * \frac{1}{100\ \text{amps}} * 540\ \text{kg} * 90\ \text{anodes} = 140\ \text{years}$$

$$\text{Anodes Required} = \frac{\text{Surface Area} * \text{Current Density}}{\text{Anode Output}} = \frac{12130\ \text{m}^2 * 75\ \text{mA/m}^2}{100\ \text{A}} = 9\ \text{anodes}$$

Magnesium Anode Bracelet Pipe Calculation Example

Pipe Length=15 m

Pipe Outside Diameter=1.2 m

Anode Material=H-1 sacrificial magnesium anode alloy

Anode Current Capacity=1100 amp-hr/kg

Anode bracelets=50 mm thick×1.2 m ID×610 mm long

Anode Weight =

$$610\ \text{mm} * \pi * \left[\left(\frac{1.2\ \text{m} + 50\ \text{mm}}{2}\right)^2 - \left(\frac{1.2\ \text{m}}{2}\right)^2\right] * 1.74\frac{\text{gm}}{\text{cm}^3} = 102\ \text{kg}$$

$$\text{Number of anodes} = \frac{15\ \text{m}}{(610\ \text{mm length} + 150\ \text{mm spacing})} = 20\ \text{bracelets}$$

Seawater Resistivity=28 ohm-cm

Resistance/1000 m of 4/0 copper cable=0.1482 ohm

Grounding=triple 4/0 cables each 15 m long $$r_{anode} = \frac{(1.2\ \text{m} + (2 * 50\ \text{mm}))}{2} = 650\ \text{mm}$$

$$\text{Anode Resistance} = \frac{\rho}{2\pi L}\left[\ln\left(\frac{4 * L}{r}\right) * -1\right] \text{ where } L = 15\ \text{m}$$

$$= \frac{28\ \text{ohm-cm}}{2\pi 15\ \text{m.}}\left\{\ln\left(\frac{4 * 15\ \text{m}}{650\ \text{mm}}\right) - 1\right\} = 0.0105\ \text{ohm}$$

-continued $$r_{cable} = \frac{0.1482 * 10^{-5}\ \text{ohm/m} * 15\ \text{m}}{3\ \text{conductors}} = 0.00074\ \text{ohm}$$

$$\text{Anode Output} = \frac{1.5\ \text{V} - 0.80\ \text{V}}{\text{Anode Resistance} + r_{cable}} = \frac{0.7\ \text{V}}{(0.0105 + .00074)\ \text{ohm}} = 62.3\ \text{amps}$$

System Life =

$$\frac{1100\ \text{amp hr}}{\text{kg}} * \frac{1}{62.3\ \text{amps}} * 102\ \text{kg} * 20\ \text{braceletes} = 4.1\ \text{years}$$

Conventional Anode Pairs Calculation Example

Anode Material=Aluminum-Zinc-Indium sacrificial anode alloy

Anode Current Capacity=2535 amp-hr/kg

Anode Dimensions=3 m×280 mm×250 mm (Trapezoidal Prism)

Anode Weight of Al=540 kg

Anode Core=150 mm, schedule 80 pipe

Anode standoff=300 mm

Seawater Resistivity=28 ohm-cm

Structure Surface Area=12130 $m^2$

Required current density=75 $mA/m^2$

Platform Member for mounting=250 mm $$r_{anode} = \frac{(280\ \text{mm} * 2 + 250\ \text{mm} * 2)}{2\pi} = 168\ \text{mm}$$

$$r = \sqrt{2r_{anode} * \left(\frac{300\ \text{mm} * 2 + 250\ \text{mm}}{2}\right)} = 378\ \text{mm}$$

Anode Resistance =

$$\frac{\rho}{2\pi L}\left\{\ln\left\{\left(\frac{2L}{r}\right) * \left(1 + \sqrt{1 + \left(\frac{r}{2L}\right)^2}\right)\right\} + \frac{r}{2L} - \sqrt{1 + \left(\frac{r}{2L}\right)^2}\right\}$$

where $L = 150$ m $$= \frac{28\ \text{ohm-cm}}{2\pi 3\ \text{m}}\left\{\ln\left\{\left(\frac{2 * 3\ \text{m}}{378\ \text{mm}}\right) * \left(1 + \sqrt{1 + \left(\frac{378\ \text{mm}}{2 * 3\ \text{m}}\right)^2}\right)\right\} + \left(\frac{378\ \text{mm}}{2 * 3\ \text{m}}\right) - \sqrt{1 + \left(\frac{378\ \text{mm}}{2 * 3\ \text{m}}\right)^2}\right\} = 0.037\ \text{ohm}$$

$$\text{Anode Output} = \frac{1.10\ \text{V} - 0.80\ \text{V}}{\text{Anode Resistance}} = \frac{0.3\ \text{V}}{0.037\ \text{ohm}} = 8.1\ \text{amps}$$

$$\text{System Life} = \frac{2535\ \text{amp hr}}{\text{kg}} * \frac{1}{8.1\ \text{amps}} * 540\ \text{kg} * 2\ \text{anodes} = 38.5\ \text{years}$$

Anodes Required =

$$\frac{\text{Surface Area} * \text{Current Density}}{\text{Anode Output}} = \frac{12130\ \text{m}^2 * 75\ \text{mA/m}^2}{8.1\ \text{A}} = 112\ \text{anodes}$$

What is claimed is:

1. A cathodic protection system for an offshore structure placed on the ocean floor, comprising:

(a) an elongated anode carrier placed on the ocean floor;

(b) a plurality of sacrificial anodes fixedly secured and electrically connected along the length of the anode carrier to form an elongated anode system; and (c) a conductor for electrically connecting said elongated anode system to the offshore structure.

2. The system of claim 1 wherein said elongated anode carrier is a pipe.

3. The system of claim 1 wherein the offshore structure includes a template placed on the ocean floor, and the elongated anode system is electrically connected to the template.

4. The system of claim 1 wherein he elongated anode system is longer than the depth of the ocean near the offshore structure.

5. The system of claim 1 additionally comprising one or more supports to elevate the elongated anode system above the mud line on the ocean floor.

6. The system of claim 1 wherein the elongated anode system is securely attached to the offshore structure by mechanical means.

7. The system of claim 1 wherein a plurality of the elongated anode systems are placed about the perimeter of the offShore structure.

8. A sacrificial anode apparatus for use on a metallic structure placed in contact with brine, said apparatus comprising:

(a) an elongated anode carrier placed on the ocean floor;

(b) a plurality of sacrificial anodes fixedly secured and electrically connected to the anode carrier, wherein the anodes are located in close proximity to each other along the length of the anode carrier to form a long anode system; and (c) conductive means for electrically connecting said anode carrier to the metallic structure.

9. The apparatus of claim 8 wherein the anode carrier is a pipe.

10. The apparatus of claim 8 wherein sections of the anode carrier with anodes attached are combined to form the long anode system.

11. The apparatus of claim 10 wherein the long anode system is at least 20 feet long.

12. The apparatus of claim 10 wherein the long anode system includes a plurality of supports.

13. The apparatus of claim 10 wherein the long anode system additionally comprises mechanical means for securely connecting the long anode system to the metallic structure.

14. A method for cathodically protecting metallic structures placed in contact with the ocean floor, comprising:

(a) securing a plurality of sacrificial anodes along the length of an anode carrier to form an anode section;

(b) electrically connecting a plurality of anode sections to form an elongated anode system;

(c) connecting an electrical conductor to the elongated anode system;

(d) placing the elongated anode system on the ocean floor; and (e) connecting the electrical conductor to the metallic structure.

15. The method of claim 14 wherein the elongated anode system is at least 20 feet long.

16. The method of claim 14 wherein the anode carrier is a pipe.

17. The method of claim 14 wherein a plurality of the elongated anode systems are placed on the ocean floor about the perimeter of the metallic structure.

18. The method of claim 14 wherein the elongated anode system is longer than the depth of the ocean near the metallic structure.

19. The method of claim 14 wherein the metallic structure includes a template placed in contact with the ocean floor, and the elongated anode system is electrically connected to the template.

20. The method of claim 14 wherein the elongated anode system additionally comprises one or more supports to elevate the anode system above the mud line on the ocean floor.

* * * * *